United States Patent [19]

Zango

[11] Patent Number: 4,794,936

[45] Date of Patent: Jan. 3, 1989

[54] COSMETIC SAMPLER

[76] Inventor: Linda Zango, Suite 610, 1160 Fifth Avenue, New York, N.Y. 10029

[21] Appl. No.: 62,709

[22] Filed: Jun. 15, 1987

[51] Int. Cl.[4] ..... A45D 40/30

[52] U.S. Cl. ..... 132/320

[58] Field of Search ..... 40/625; 132/88.7; 401/40, 49; 15/140.3; 128/269

[56] References Cited

U.S. PATENT DOCUMENTS

| | | | |
|---|---|---|---|
| 2,162,584 | 6/1939 | Kole | 401/49 |
| 2,344,060 | 3/1944 | Ray | 401/49 |
| 3,453,056 | 7/1969 | Motsavage et al. | 401/49 |
| 3,863,654 | 3/1975 | Morane et al. | 128/88.7 |
| 4,628,950 | 12/1986 | Bitzer . | |
| 4,669,492 | 6/1987 | von Kleinsorgen | 132/88.7 |

*Primary Examiner*—Gene Mancene
*Assistant Examiner*—Wenceslao Contreras
*Attorney, Agent, or Firm*—Toren, McGeady & Associates

[57] ABSTRACT

A cosmetic sampler for applying various cosmetic preparations is made up of an applicator and a cover. The applicator has a rod-like section for the cosmetic preparation and the cover fits over and encloses the rod-like section. The applicator is formed of a plastic material compatible with the cosmetic preparation.

14 Claims, 1 Drawing Sheet

COSMETIC SAMPLER

BACKGROUND OF THE INVENTION

The present invention is directed to a cosmetic sampler for use in the test application of a cosmetic preparation. The sampler includes an applicator with a rod-like section on which the cosmetic preparation is deposited and a cover for enclosing and protecting the cosmetic preparation. The rod-like section of the applicator is formed of a plastic material compatible with the cosmetic.

In the past, cosmetic preparations have been made available to potential customers usually at a point-of-purchase in the form of tubes such as tubes of lipstick. In the case of lipstick or eye shadow, samples of various colors are provided, however, not in a sanitary disposable individual sampler form.

Attempts to provide single use disposable samplers has faced the problems that the applicator member may be abrasive and co-acts in a deleterious manner with the cosmetic preparation. Another problem has been to find a material used for the applicator which is compatible with the cosmetic preparation and, in the case of lipstick, does not result in a breakdown or disintegration of the material forming the applicator.

SUMMARY OF THE INVENTION

Therefore, it is the primary object of the present invention to provide a compact, sanitary disposable cosmetic sampler where the cosmetic is protected while on display and the applicator can be used without any damaging effect and then disposed of.

In accordance with the present invention, the cosmetic sampler is formed of an applicator with a rod-like section on which the cosmetic is deposited and a cover for enclosing the cosmetic while it is on display with the cover being easily removable so that a potential customer can apply the cosmetic.

A significant feature of the invention is the use of styrene acrylinitrile (S.A.N.) as the carrier or support for the cosmetic preparation. It has been found, particularly for lipstick, that the S.A.N. plastic remains compatible with lipstick over an extended period and does not result in any breakdown of the lipstick or the plastic.

In the present invention by using S.A.N. as the material for at least the portion of the applicator on which the lipstick or other cosmetic preparation is applied, there is no danger in breakdown of the cosmetic or of the plastic carrier. Moreover, while it is possible to use the S.A.N. as the material for forming the cover, other clear plastic materials can be used, since the material of the cover does not touch the lipstick.

Another significant feature of the use of S.A.N. as the support for the cosmetic preparation is that it can form a smooth, non-abrasive applicator which is very safe in use. It can be appreciated that the use of applicators tending to scratch the skin of a potential customer could result in product liability problems.

For the first time in the cosmetic industry, the present invention affords an effective, compact, sanitary disposable sampler applicator. Personal trial sampling of different colors and formulations can be effected assisting a potential customer in making a purchase. At the present time, in testing cosmetic preparations, such as lipstick and eye shadow, public tester counter displays have been used which have not been sanitary and, as a result, have limited the use of such displays.

In accordance with the present invention, the cosmetic sampler can be made up of a monolithic or unitary applicator and a cover for at least the part of the applicator on which the cosmetic preparation is deposited. The applicator is formed of an axially extending rod-like section having a first end and a second end. The cosmetic preparation is applied to the first end in a sufficient amount for a potential customer to make an effective test of the suitability of the cosmetic. Only a portion of the rod-like first section is covered with the cosmetic. At the second end of the rod-like section, a second section is provided extending laterally outwardly from the rod-like section and arranged to form a seat for the cover. A third section extends axially from the second section in the direction away from the first section and forms a holder for the applicator. The cover is a cylindrically-shaped member with a blind bore extending from an open end to a closed end. The cover fits over the rod-like section and is secured in a press fit on the second section. Preferably, the third section forming the holder is not enclosed by the cover so that it can be gripped for removing the cover and then applying the cosmetic. For cost reasons, it is preferable if the various sections of the applicator are formed as a unit.

An essential feature of the invention is that the first section, in the event the applicator is not monolithic, is formed of styrine acrylinitrile. The cover may be formed of the same plastic material or of another clear plastic so that it encloses the cosmetic preparation while permitting it to be viewed by potential customers.

With the cover forming a closure over the applicator, the cosmetic preparation is protected while it is on display and can be easily viewed in an attractive surrounding. The cosmetic samplers can be arrayed in a display stand, secured on promotional cards, or provided in baskets for use by potential customers. The cosmetic sampler of the present invention has a wide variety of uses as a sampling or testing device, not only for a wide range of cosmetics, but for other types of products, such as pharmaceuticals.

A particularly significant feature of the invention is the sanitary usage afforded for a cosmetic sampler. The cosmetic preparation is protected until it is ready to be used and, since it is compatible with the material on which the preparation is deposited, there is little chance of contamination and, further, there is no problem of deterioration of the preparation or of the support material. Further, because of the characteristic of the S.A.N. material, it provides a smooth applicator surface which cannot injure or scratch the lips or eyes of a potential customer.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
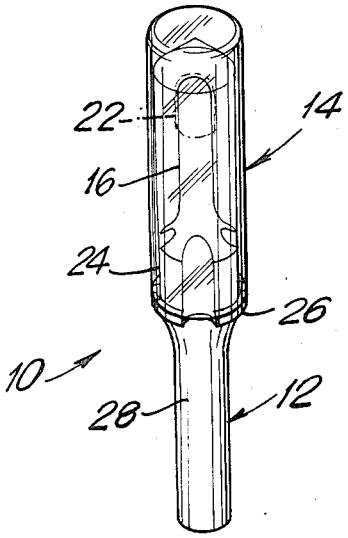
FIG. 1 is a perspective view of a cosmetic sampler formed of an applicator and a cover and embodying the present invention.

In FIG. 1, a cosmetic sampler 10 is formed of an axially elongated applicator 12 and a cover 14 fitted over one end of the applicator. The applicator 12 is formed of a plastic material as is the cover and preferably the cover is transparent so that the cosmetic preparation on the applicator can be viewed.

The applicator 12 has an axially elongated rod-like first section 16, having a first end 18, and a second end 20. The cosmetic preparation 22, shown in dashed lines, is deposited on the first end.

A second axial extending section 24 extends from the second end of the rod-like first section 16 with the second section being symmetrical relative to the axis of the applicator and projecting radially outwardly from the first section. The second end 20 of the first section 16 forms a transition section tapering outwardly from the smaller diameter first section to the larger diameter second section 24.

Figure 2:
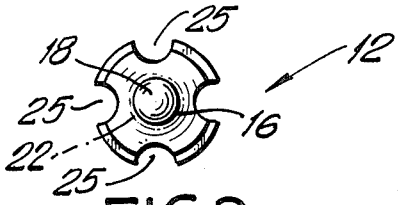
FIG. 2 is a top end view of the applicator.
Figure 3:
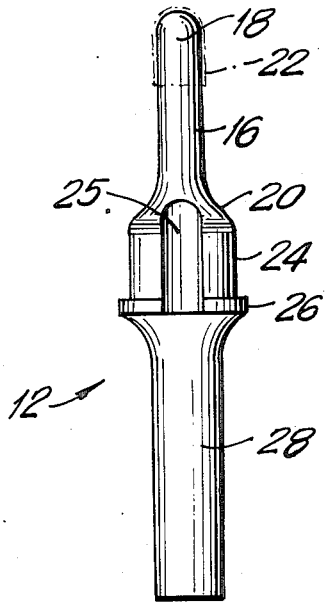
FIG. 3 is an elevational view of the applicator.

The second section 24 has four axially extending rounded grooves 25 spaced equi-angularly apart in its outer surface so that as viewed in FIG. 2, the second section has a cross-like configuration. At the opposite end of the second section 24 from the second end 20 of the first section 16, an outwardly projecting annular bead 26 is provided forming a seat for the cover 12.

A third axially extending section 28 projects from the bead 26 at one end of the second section in the direction away from the first section 16. The third section has a transition section tapering inwardly from the bead to a smaller diameter part of the third section. The third section has a smaller diameter than the second section, however, a larger diameter than the first section. The third section 28 forms a holder for the applicator 12.

In one embodiment, the over-all length of the applicator is approximately 1.9 inches with the first and second sections forming approximately one-half of the applicator and the third section forming the other half. The first section 16 has a diameter of about ⅛th of an inch, the second section has a maximum diameter of about ⅜ths of an inch, while the third section has a diameter outside the transition section of about 0.2 of an inch. Preferably, the applicator is formed as a monolithic member and is made of styrene acrylinitrile or S.A.N. It is essential that the first section 16 of the applicator 12 is formed of the S.A.N. and it would be possible to form the remainder of the applicator of another plastic material, if necessary, for costs reasons.

Figure 5:
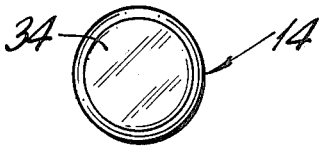
FIG. 5 is a top end view of the cover.
Figure 4:
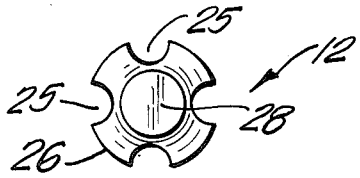
FIG. 4 is a bottom end view of the applicator.
Figure 6:
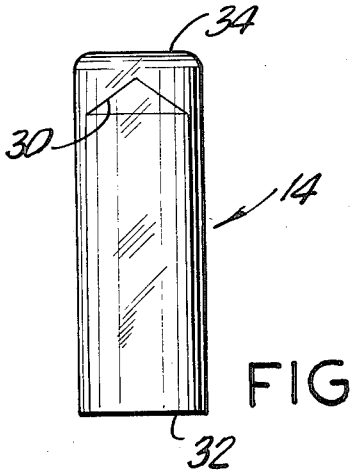
FIG. 6 is an elevational view of the cover.
Figure 7:
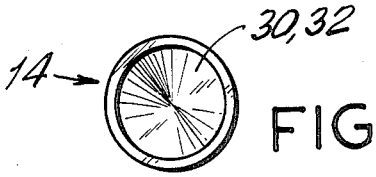
FIG. 7 is a bottom end view of the cover.

As shown in FIG. 5, the cover 14 is a cylindrically-shaped member with a blind bore 30 extending between an open end 32 and a closed end 34. The inside diameter of the bore is substantially the same as the diameter of the second section 24 so that the open end of the cover is received on the second section 24 with a press fit. The open end 32 of the cover 14 bears against the bead 26 at the lower end of the second section 24 of the applicator 12 so that a closure is provided about the first section 16 of the applicator on which the cosmetic preparation 22 is deposited.

The closed end 34 of the cover 14 is shown having a flat end surface transverse of the axial direction of the cover, however, the cover may have other shapes for aesthetic appearance.

When the cosmetic sampler 10 is displayed, as shown in FIG. 1, the cover 14 fits over the first section 16 of the applicator and is secured by a press fit about the second section 24. The bore 30 within the cover is dimensioned so that its surface is spaced from the cosmetic preparation 22 and does not cause the preparation to smear or run on the inside surface of the cover.

When a potential customer wishes to try the cosmetic preparation, by holding the applicator 12 at the holder or third section 28, the cover can be removed by pulling it in the axial direction away from the bead 26 uncovering the cosmetic preparation 22. The cosmetic preparation can be applied and, if desired, the cover can be replaced so that the sampler can be re-used. It is also possible after a single application that the applicator and the cover can be thrown away.

The surface of the rod-like first section 16 of the applicator 12, is smooth and does not tend to scratch when it is used. The S.A.N. material forming the first section, as mentioned above, is compatible with the cosmetic preparation, accordingly, it affords an accurate sampling of the preparation.

While specific embodiments of the invention have been shown and described in detail to illustrate the application of the inventive principles, it will be understood that the invention may be embodied otherwise without departing from such principles.

I claim:

1. A cosmetic sampler comprising a cosmetic applicator and a removable cover for said applicator, said applicator comprising an axially extending rounded rod-like section having a first end and a second end with said section having a smooth surface axially extending first part extending from the first end and being spaced from the second end and said first part arranged to receive a cosmetic preparation deposited directly thereon, means on said rod-like section at the second end forming a seat for said cover so that the cover encloses and is spaced outwardly from said rod-like section, and a holder extending in the axial direction of said rod-like section away from the second end thereof, and said rod-like section being formed of styrene acrylinitrile.

2. A cosmetic sampler, as set forth in claim 1, wherein said rod-like section and said holder are formed monolithically.

3. A cosmetic sampler, as set forth in claim 2, wherein said holder is axially symmetrical with said rod-like section.

4. A cosmetic sampler, comprising a cosmetic applicator and a removable cover for said applicator, said applicator comprising an axially extending rounded rod-like first section having a first end and a second end, an enlarged, compared to said rod-like first section, second section secured to the second end of said first section and extending in the axial direction of said first section away from the second end thereof, and a third section secured to said second section and extending in the axial direction of said first section away from first and second sections, said third section forming a holder for applying a cosmetic preparation directly deposited on an axially extending smooth surface part extending from the first end of said first section and being spaced from the second end, said first, second and third sections being monolithic and formed of styrene acyrlinitrile, and said cover at least completely enclosing and spaced outwardly from said first section.

5. A cosmetic sampler, as set forth in claim 4, wherein said first section has a generally circular transverse section and is spherically shaped at the first end thereof.

6. A cosmetic sampler, as set forth in claim 5, wherein said second section is axially symmetrical relative to said first section and projects laterally outwardly from said first section.

7. A cosmetic sampler, as set forth in claim 6, wherein said cover comprising an axially extending generally cylindrically-shaped member having a closed first end and an open second end and having a hollow bore extending from the second end toward the first end, and said bore having an axial length and diameter greater than the axial length and diameter of said first section, so that said first section fits into the bore without contact with the surface thereof.

8. A cosmetic sampler, as set forth in claim 7, wherein said second section forms a seat encircling the axis of said first section for receiving and forming a closure for the second end of said cover.

9. A cosmetic sampler, as set forth in claim 8, wherein said second section and said hollow bore in said cover are dimensioned to provide a press fit therebetween.

10. A cosmetic sampler, as set forth in claim 7, wherein said cover is formed of a transparent plastics material.

11. A cosmetic sampler, as set forth in claim 6, wherein said applicator has an axially extending transition section tapering outwardly adjacent the second end of said first section to said second section.

12. A cosmetic sampler, as set forth in claim 8, wherein said third section has an axially extending transition section tapering inwardly from said second section and a axially extending holder section of uniform diameter extending from said transition section.

13. A cosmetic sampler, as set forth in claim 8, wherein said second section has a plurality of axially extending angularly spaced grooves therein.

14. A cosmetic sampler, as set forth in claim 13, wherein said grooves are equi-angularly spread apart and are rounded transverse to the axial direction.

* * * * *